United States Patent [19]

Duinker

[11] 4,158,409

[45] Jun. 19, 1979

[54] PACKING FOR SINGLE FILMS

[76] Inventor: Simon Duinker, Bloemendaal-Molan 1, Netherlands

[21] Appl. No.: 816,476

[22] Filed: Jul. 18, 1977

[30] Foreign Application Priority Data

Jul. 16, 1976 [DE] Fed. Rep. of Germany ..... 2632041

[51] Int. Cl.[2] ..... B65D 85/00; B65D 85/30; B65D 85/62

[52] U.S. Cl. ..... 206/455

[58] Field of Search ..... 206/455, 456, 820, 37, 206/629, 484

[56] References Cited

U.S. PATENT DOCUMENTS

| | | | |
|---|---|---|---|
| 2,194,451 | 3/1940 | Soubier | 206/820 |
| 3,615,711 | 10/1971 | Markus et al. | 206/629 |
| 3,741,386 | 6/1973 | Schmidt | 206/455 |
| 3,921,802 | 11/1975 | Thompson | 206/37 |

*Primary Examiner*—William T. Dixson, Jr.

[57] ABSTRACT

The packing has a smooth, tension-proof, plastic and metallic foil arrangement which surrounds a stack of films in a light-proof and weather-proof manner. Two parallel weld seams weld the foil together at the stack edges and a third weld seam extends vertically thereto. The film stack is embraced somewhat loosely between the welds. The foil extends as a holding strip beyond one of the parallel weld seams and as a substantially longer pull strap beyond the other weld seam. A gusset of the foil arrangement disposed between one weld seam and the film stack has a width allowing the gusset to be cut open and off.

25 Claims, 12 Drawing Figures

PACKING FOR SINGLE FILMS

The invention relates to a packing for a plurality of flat rectangular single films which have the same emulsion orientation and lie one above the other in a stack so that they are approximately in coincidence, the packing having a foil arrangement, which surrounds the stack in a light-proof and weather-proof manner and has an easily weldable plastics material foil as its internal layer, an aluminium foil as its central layer and an external layer on the outside, and comprising weld seams welding the foil arrangement together and of which two extend in parallel in the area of each stack edge and at least one weld seam extends vertically thereto and meets the two other weld seams.

Packings of this type are used, for example, in the field of medicine. They are operated in cameras photographing, for example, fluorescent X-rays. The cameras have photographic speeds of approximately 2 to 12 pictures per second. It is, of course, also possible to take single pictures. However, the relatively high photographing speeds have the advantage that it is also possible to record sequences. Because of the high single picture consumption, there are assorted in the stack, for example, 50 single pictures which have the meanwhile standardised format of 100×100 mm. An orientation notch has been cut into one side of the single films. The stack is wrapped in paper and is packed with the latter in a foil arrangement which has a polyethylene layer on the inside, an aluminium foil in the middle and a usually black paper layer on the outside. The foil arrangement is very closely adapted to the stack. The foil arrangement is packed, in turn, in a small box comprising a bottom shell and a cover, whose edge is glued to a warranty strip. The cost share of this packing is high and is of the same order as the films themselves. Prior to photographing, the stack has to be inserted into an expensive cassette. For this purpose, a person takes the cassette and a new box to the dark room, opens the box and rips up the foil arrangement. He removes the stack from the foil arrangement, feels for the notch and places the stack into the cassette.

The consumption of single films is already high for original photographs, but for copying for recording purposes it is even higher. It can easily happen that 1000 copies are made per day in a hospital.

The known packings have the following disadvantages:-

(a) Loading in daylight is impossible. A dark room and its expenditure are therefore absolutely necessary.

(b) In order to fill the cassettes, one has to leave the photographing unit and go into the dark room.

(c) Only skilled persons reliably know what position the notches must have and also where the emulsion side is located in relation to the notch.

(d) If one wants to avoid the problem of continuous loading, one has to buy a number of cassettes. However, these are expensive.

(e) If one has a plurality of cassettes and one is not very careful, it can happen that one mistakes unloaded cassettes for loaded ones.

(f) It is absolutely necessary to remove the stack from the packing by hand. This may cause finger prints to be produced on the single films.

(g) In the same way as in a card game, it is very difficult to hold 50 single pictures securely by hand. If the stack slips, one cannot find it in the darkness.

(h) It happens that some of the 50 individual films slip out in the dark room without this being noticed. Contrary to one's expectations, the cassette is then only partly loaded.

(i) If, for example, 1000 copies are made per day in a hospital and one has four cassettes, this means that 5×4, that is to say 20 cassettes have to be loaded.

(j) The known packings lead to a voluminous wastage of a very varied nature, namely box parts plus foil arrangement parts plus reinforcing cardboard.

It is the object of the invention to indicate a packing which avoids the afore-mentioned disadvantages and which, in particular, is cheap and which, above all, allows loading by daylight in conjunction with the cassettes provided for the various applications and whose handling does not impose any substantial requirements on the staff and which requires a minimum of single components (apart from the stack) and which provides wastage that can be easily handled.

According to the invention, this task is solved by the following features:

(a) In the direction running parallel to the first two weld seams, the foil arrangement embraces the stack to an extent that is so loose and not tightly fitting that a movement of the stack vertical to the two weld seams is possible but the coherence of the stack is maintained.

(b) The foil arrangement extends as a holding strip beyond one of the two first weld seams.

(c) The gusset of the foil arrangement disposed between this one weld seam and the stack has a width allowing the gusset to be cut open and off.

(d) The foil arrangement extends as a pull strap beyond the other of the two first weld seams and is substantially longer than the holding strip.

(e) The external layer is a smooth, tension-proof plastics material foil.

Foils of this kind are low in friction in the direction of the stack and also in the direction of the cassette. The external layer can neither produce nor take along any fluff. The internal, central and external layers can be cut easily and in a defined manner without tearing. The plastics material foils represent a cleaning agent for the knives to be used, thus avoiding the formation on the knives of chips from the cut aluminium. The packing of the individual stacks is light-proof and weather-proof and allows a filling of clean air of a specific relative air humidity (in most cases 50%), which is required for the storage of the films. The packing is easy and safe to handle, does not require a box, is robust, consists of an absolute minimum of parts, produces waste which can be easily removed, cannot be inserted into the cassette the wrong way round due to its shape, allows automatic daylight loading of different cassettes, necessitates very simple packing machines, has a minimal space requirement for storage, is extremely cheap and can also be inexpensively provided with operating instruction labels or advertising labels.

Features in the exemplified embodiments ensure both a reduction of costs and a more reliable function because there is no need for any intermediate cardboard to be removed. Furthermore, the packing does not contain any other object which might produce fluff particles.

Features in the exemplified embodiments ensure an easy weldability together with low friction and allow the non-fluff properties of the polyethylene foil to be exploited if the intermediate cardboard is omitted.

Features in the exemplified embodiments bring about a particularly tension-proof, mechanically stable foil which, in contrast with the polyethylene foil and the aluminium foil, has a high recovery force even after it has been folded.

Features in the exemplified embodiments ensure that turning-in has to be effected only once during the production of a foil web. The weld seam is then located at a point which is subjected to few stresses. But, above all, it is ensured that the single film edges which are parallel to the direction of tension cannot get entangled. This would certainly happen if this welding seam were arranged beside one of the longitudinal edges of the stack. A wedge-shaped gusset would then be formed.

Features in the exemplified embodiments ensure symmetry during the packing operation, and it is furthermore ensured that approximately the same space is provided to the right and left of the weld seam to allow for the plunging of the plunger knives, so that there is then no need for them to cut in the weld seam or in the multi-layer fold.

Features in the exemplified embodiments ensure that the gusset to be cut off is, above all, correctly positioned and the stack is not cut by error.

Features in the exemplified embodiments ensure that the positioning accuracy is improved.

Features in the exemplified embodiments ensure an excellent formation which is adapted to mass consumption both as regards the packing machinery and the transportation of large quantities and also the ultimate consumer. It is possible to arrange one stack area above the other.

The features in the first exemplified embodiment ensure an even greater tightness by way of the cross-welds. But, above all, this area is now so stiffened that it can be rolled like the track of a tractor. This has considerable advantages when the "snake" of packings is filled into containers because the pull strap now uncoils nicely and the negative creasing properties of the aluminium and polyethylene foils are overcome. However, also when the stacks are removed and later handled, these cross-welds cause the pull strap area to be no longer as unstable as it is without the cross-welds and to have a preferential direction in its stiffness.

Features in the exemplified embodiments ensure that a minimum of space is required and that the foils lying between the individual stack areas act, as it were, as springs.

Features in the exemplified embodiments ensure that the single films stay within the coherence of the stack and that it is not possible for a single film to slip out and to be later cut off. Of course, the bend is removed when the stack is inserted into the cassette. However, it is unlikely that a single film will slip out from the stack during this short period of time.

Features in the exemplified embodiments avoid the notch cutting operation, prevent edges which might get entangled and provide a smoothly and finished cut edge without any preferential direction.

The features of the second exemplified embodiments ensure that the transporting mechanisms required for the treatment by machine can be simple, for example chains or toothed belts with transporting pins.

The packing according to the first exemplified embodiment is suitable for being pulled by hand from the cassette allowing loading by daylight, the pull strap being pulled to the left. Depending on the operator's disposition, skill and strength, pulling can be effected incorrectly. For example, pulling may be effected too rapidly or in the wrong direction. Furthermore, pulling necessitates free space for the pulling hand. Since the daylight cassette is flanged onto the camera itself, the flange construction, the camera and the cassette are stressed by the pulling process.

Furthermore, the problem of light-proofness at the moment when the cassette is closed arises in the case of the packing according to the first exemplified embodiment. When the knives mounted on the top of the cassette penetrate the pull strap, the cassette is not yet completely closed, i.e. it is not yet light-proof. In spite of this, the packing is already being cut.

Finally, with such packings, attention must also be paid to the fact that some firms prefer vacuum packings while other firms prefer packings in whose interior a normal atmospheric pressure prevails.

The object of the invention in relation to the second exemplified embodiment is to indicate a packing which is suitable for production involving both normal atmospheric pressure and vacuum and which can be pulled from the daylight cassette both by hand and by motor and which avoids the lightproofness problems arising when the cassette is closed.

This measure ensures that the packing remains light-proof until the cassette is closed. The longitudinal welds connect the top and bottom of the pull strap, so that the top cannot run in advance of or behind the bottom when the extraction is effected by motor by means of rollers, particularly if one of these rollers is not driven. For this reason, no humps will form in the pull strap. Furthermore, the longitudinal weld causes a force to be introduced into the packing in the very direction in which the knife offers resistance. This leads to a smooth knife cut without any lateral tears or corrugations.

The air space in the pull strap now being connected to the air space of the intermediate part, no air cushions are formed during the withdrawal such as were formed each time between the numerous cross-welds in the pull strap of the first exemplified embodiments.

Although it is better, the packing according to the second exemplified embodiment is therefore cheaper than that of the first exemplified embodiment.

Features in the exemplified embodiments ensure that the advantages provided by the invention can also be utilised when the cassette comprises two knives.

Features in the second exemplified embodiment ensure that the end edge of the pull strap is stiffened, becomes resistant to pulling, does not open in the manner of a paper bag, allows an efficient introduction of the forces and forms, during continuous production, a good cutting area in respect of the adjoining holding strip. Furthermore, any cushion-like inclusions are then not formed in any event, which would be the case if two cross-welds were provided.

Features in the second exemplified embodiment ensure that the longitudinal welds can be kept as narrow as is required for the introduction and transfer of forces and that the pull strap is not stiffened unnecessarily, which would be unsuitable if the pull strap has to be deflected around rollers when the extraction is effected.

Feature in the second exemplified embodiment for film stacks of 100×100 mm and comprising 50 single films has proved to be very suitable.

Features in the second exemplified embodiment ensure that the widenings are sufficiently small but allow reasonable tolerances.

Features in the second exemplified embodiment ensure an approximately identical mechanical stiffness and protection against the penetration of light at both ends of the packing. The identical mechanical stiffness allows symmetrical cutting conditions.

Features in the second exemplified embodiment allow unused packs to be stored in a tidy and space-saving manner.

Features in the second exemplified embodiment ensure that the packing cannot be inserted into the cassette the wrong way round, because otherwise the pins will not pass through the positioning holes.

Features in the second exemplified embodiment ensure that the positioning holes are embedded in mechanically firm areas.

Features in the second exemplified embodiment make it possible to ensure that the single film stack of such packings remains in its desired position and that nevertheless when the packing is pulled out, there will substantially not arise any forces other than those arising in the case of vacuum packs.

The invention will now be described with reference to two preferred exemplified embodiments. In the drawings.

Figure 1:
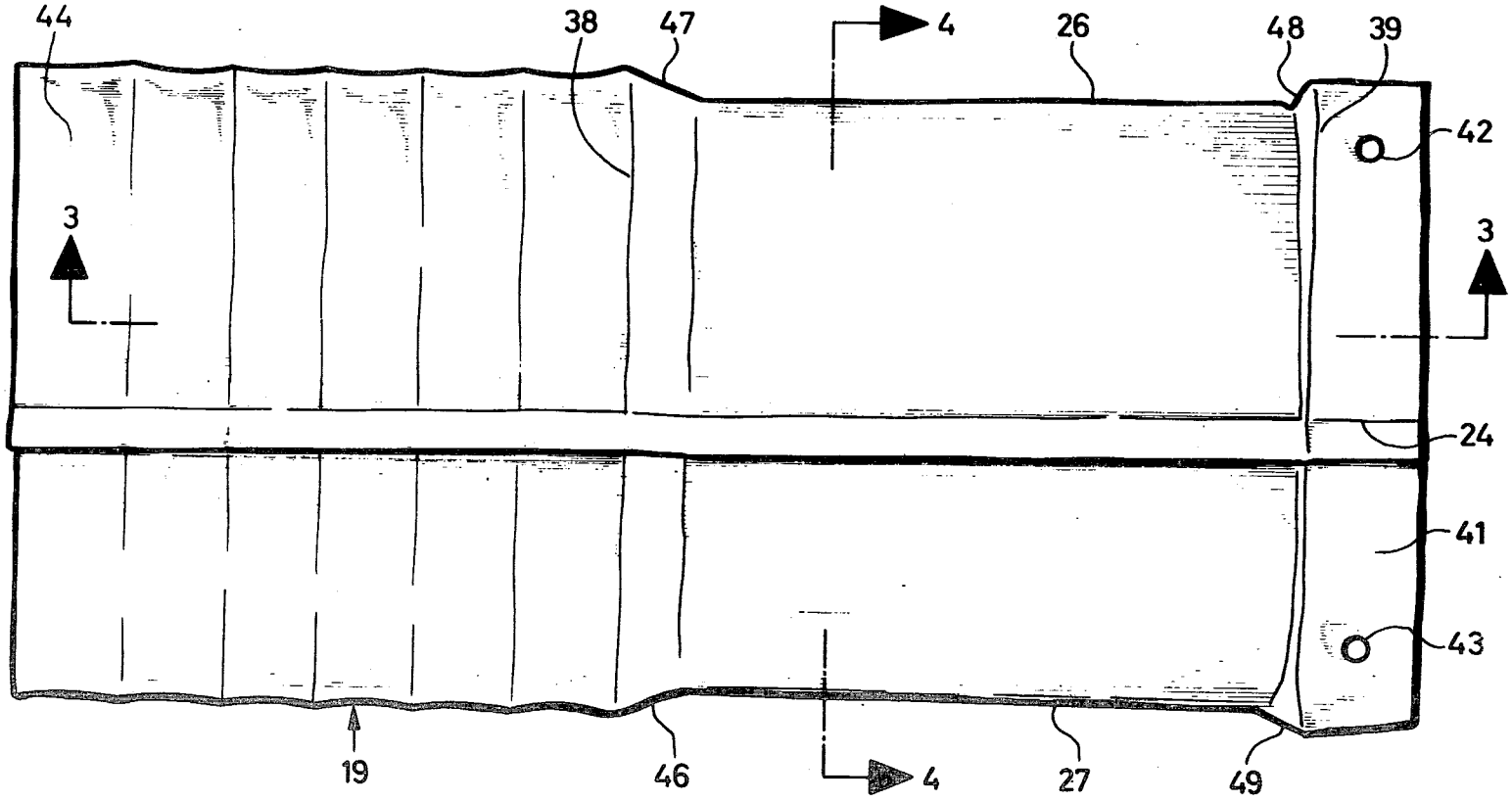
FIG. 1 shows a full-scale top view of a single pack.
Figure 2:
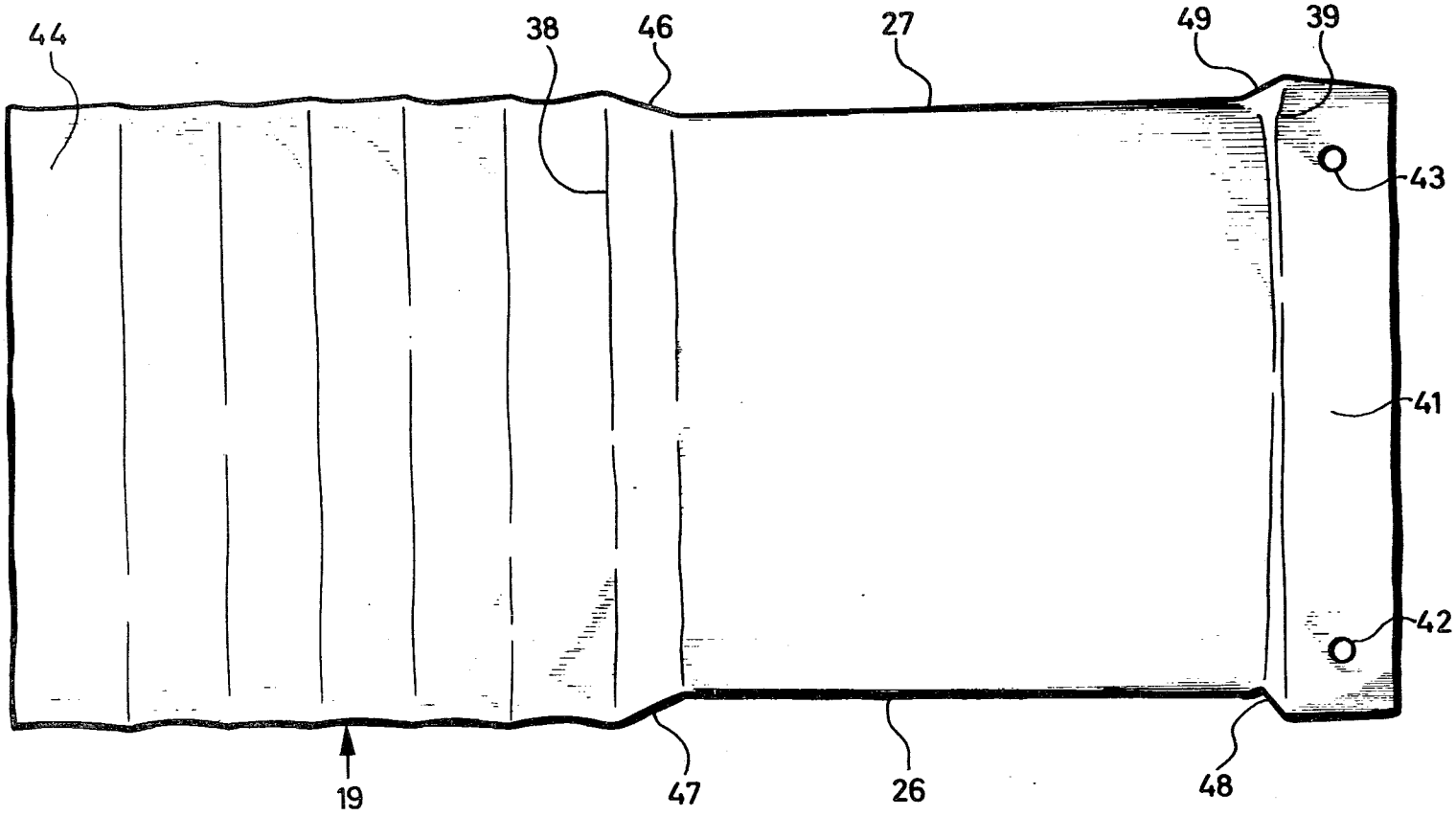
FIG. 2 shows a full-scale bottom view of the pack shown in FIG. 1.
Figure 9:
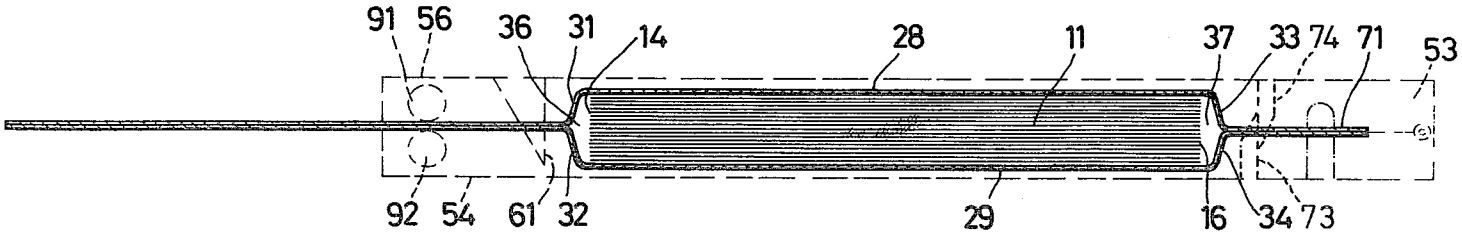
Figure 4:
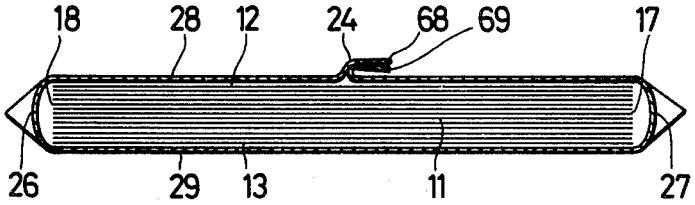
FIG. 4 shows a full-scale section along the line 4—4 shown in FIG. 1.
Figure 5:
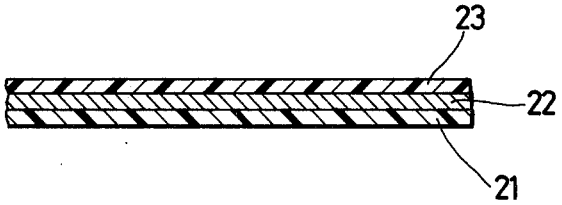
FIG. 5 shows a very substantially enlarged section through a packing wall.
Figure 6:
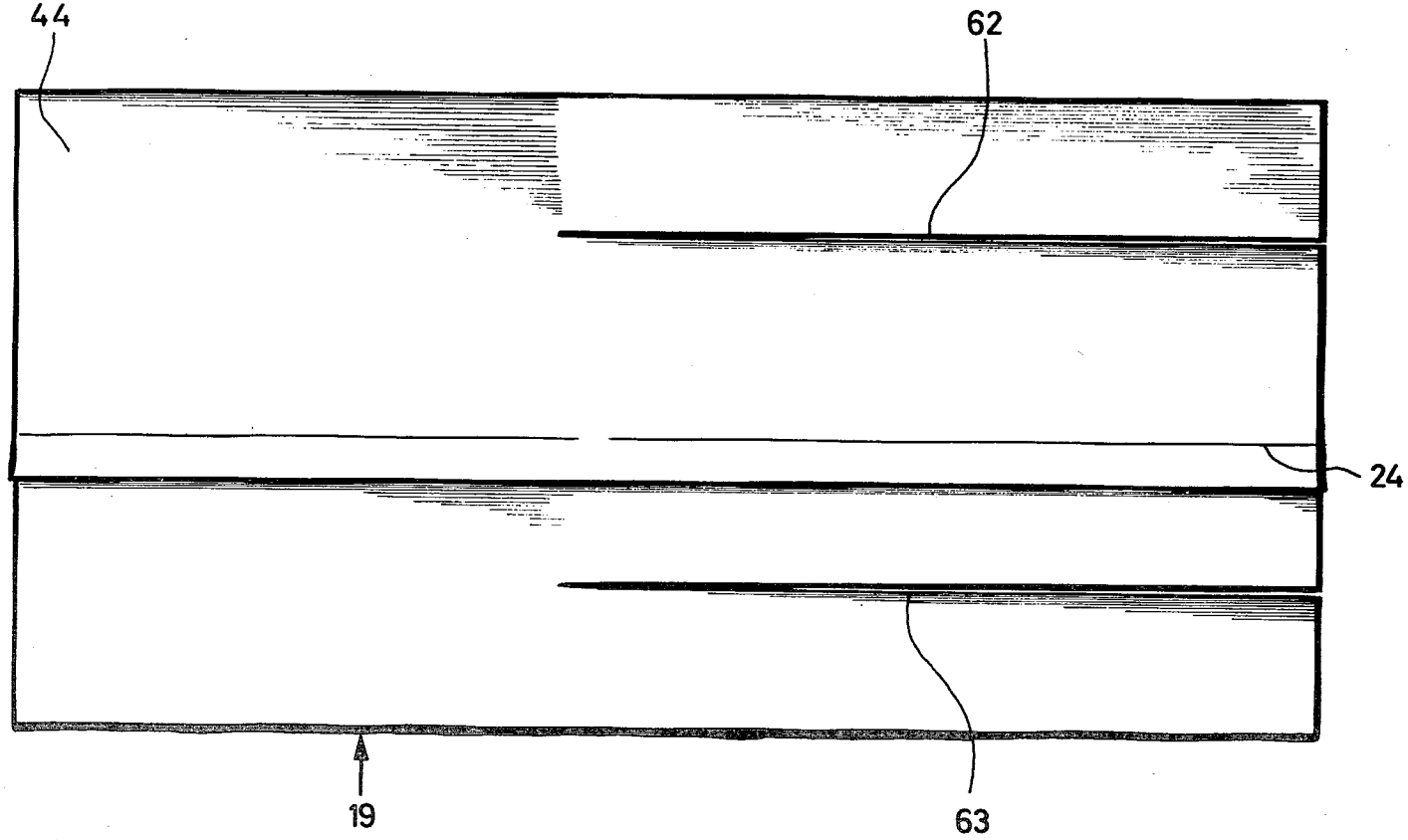
Figure 7:
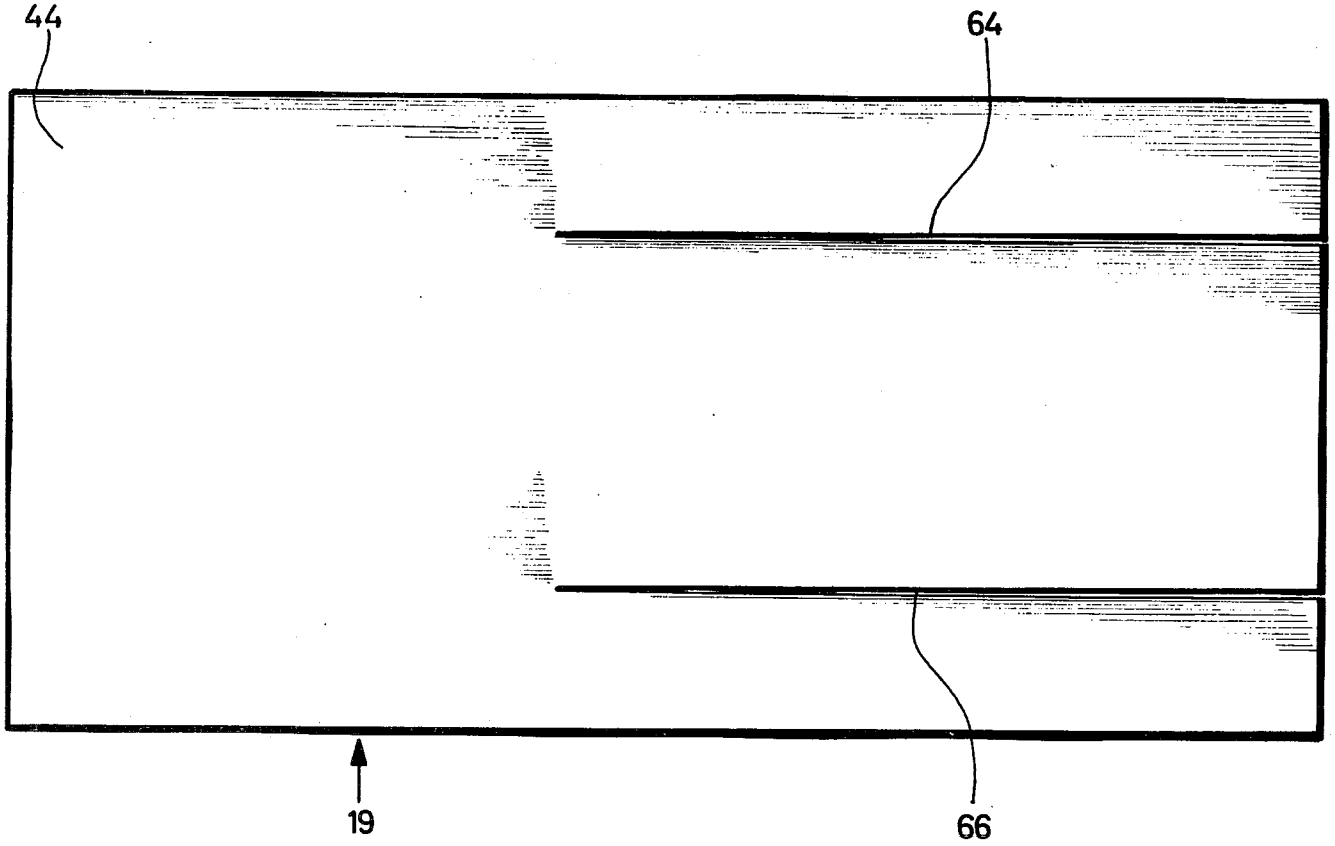
Figure 8:
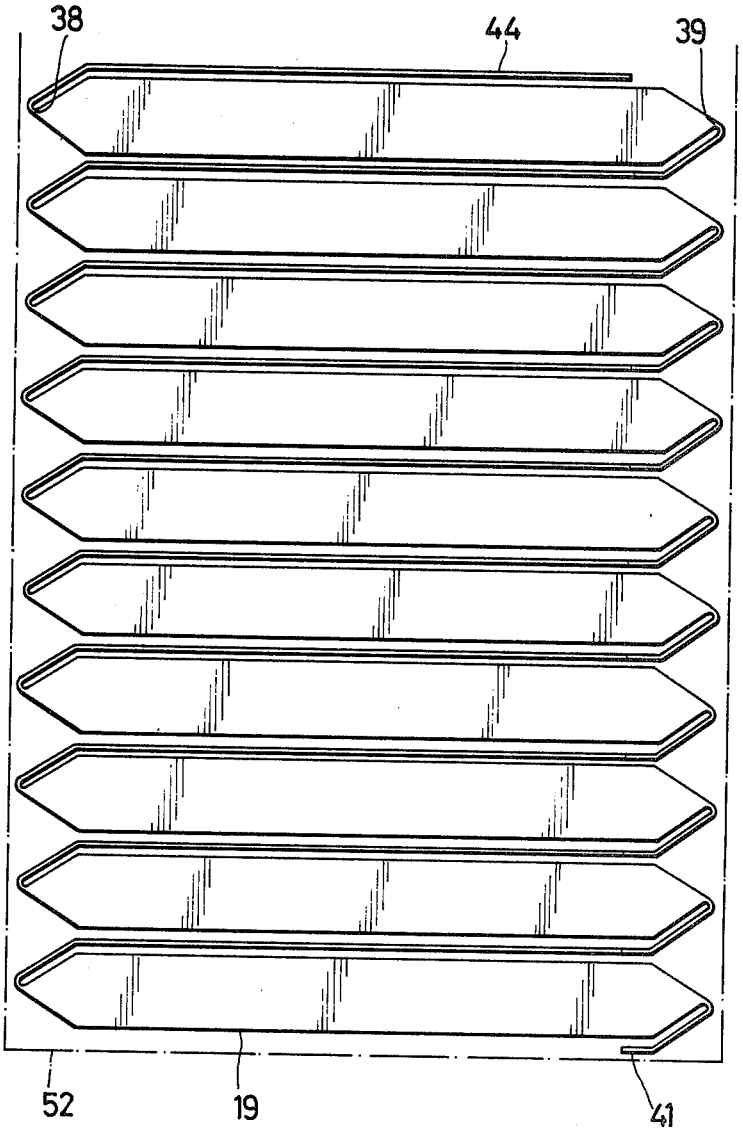
Figure 10:
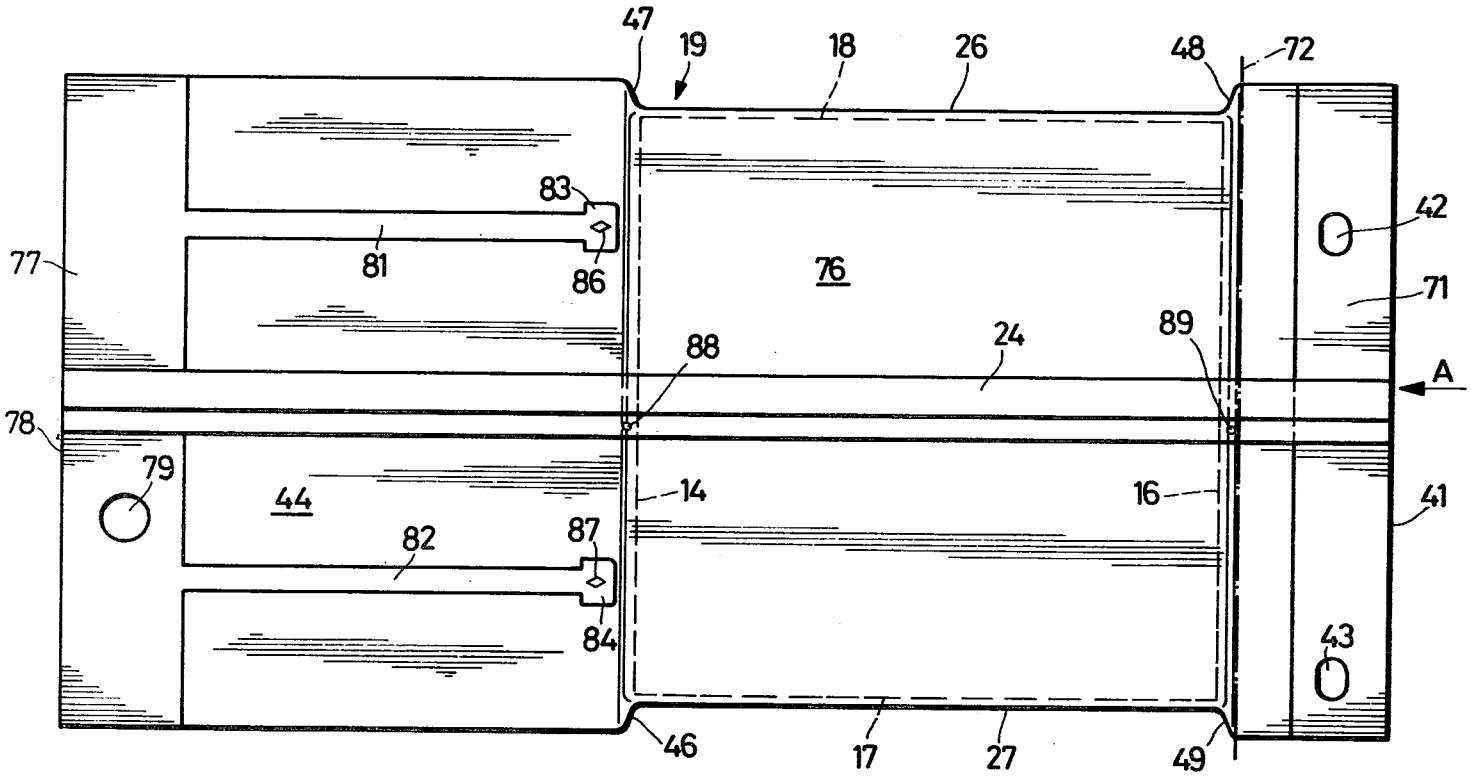
Figure 12:
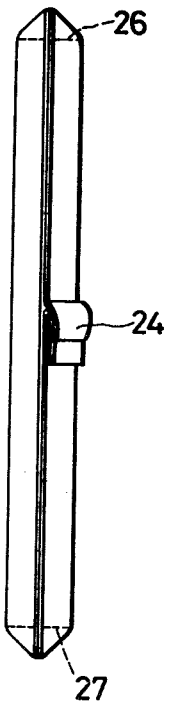
Figure 11:
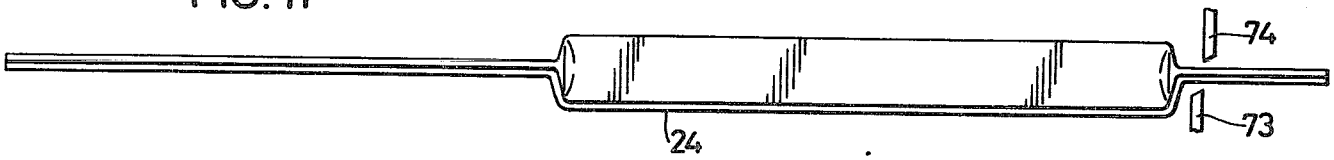

FIG. 6 shows a top view similar to that of FIG. 1 of the foil tube after it has been extracted from the cassette, FIG. 7 shows a bottom view in respect of FIG. 6, FIG. 8 shows a diagrammatical illustration of a zig-zag arrangement, FIG. 9 shows a cross section through a packing together with the film stack and the cassette, which is indicated in broken lines, FIG. 10 shows a bottom view of the packing, FIG. 11 shows a lateral view of the packing with an indication of the knives, and FIG. 12 shows a view according to the arrow A shown in FIG. 10.

An envelope 19 consists of an approximately 0,1 mm thick material; the material is a polyethylene foil 21 on the inside, an aluminium foil 22 in the middle and a polyester foil 23 on the outside.

The envelope 19 is formed as a tube by a longitudinal seam 24. The longitudinal seam 24 extends over the entire length of the envelope 19. The envelope 19 is so dimensioned that it encloses the stack 11 neither quite tightly nor in such a loose manner that the coherence between the single films in the stack 11 is lost. Due to the stiffness of the polyester foil 23, the envelope 19 extends in small curves 26, 27 on both sides of the front edge 17 and the rear edge 18 and rests against the top 12 and the bottom 13. To the left and right of the left-hand edge 14 and the right-hand edge 16 respectively, the envelope 19 is even less close-fitting. Here, the top 28 and the bottom 29 form oblique areas 31, 32, 33, 34 which extend at an angle of approximately 45° and form distinct gussets 36, 37 of prismatic shape. At the end of each gusset 36, 37, there is provided a cross-seam 38, 39 which extends across the entire envelope 19. The longitudinal seam 24 is also crossed by it. In accordance with the full-scale representation, the areas 31, 32, 33, 34 are of considerable length and the gussets 36, 37 have a greater volume than that left between the small curves 26, 27 and the front edge 17 and the rear edge 18 respectively. The areas 31, 32 and 33, 34 respectively are of equal length, so that the cross-seams 38, 39 are provided approximately half-way up the stack 11. To the right of the cross-seam 39, the envelope 19 merges in a holding strip 41 which is approximately 2 cm long, as shown in the drawing. The holding strip has two holes 42, 43 which pass through the top 28 and the bottom 29. They are circular.

To the left of the cross-seam 38, the envelope 19 merges in an approximately 11 cm long pull strap 44. In the area thereof, the top 28 and the bottom 29 are flat. The strap is 11 cm in width, so that its effective circumference is approximately 22 cm, which is an adaptation to 50 10×10 single films.

In the area of the stack 11, the envelope 19 is approximately 10,5 cm wide and, as viewed from the centre in the direction of the cross-seams 39, 38, then forms cushion tips 46, 47, 48, 49.

The pull strap 44 comprises numerous cross-welds 51 which are provided, for example, at intervals of 1 to 2 cm and extend in parallel as well as vertically to the longitudinal direction of the envelope 19.

FIGS. 1 to 4 show single packs.

According to FIG. 8, it is however possible to merge the holding strip 41 of one pack in the pull strap 44 of the packs following next, so that the packs are coherent. A preferred packing and despatch layer is then the zig-zag form shown in FIG. 8. This zig-zag layer can be accommodated in a rectangular container 52 which is open at the top and shown in dash-dotted lines, and this applies both to production and consumption.

In zig-zag storing, the areas around the cross-seams 38, 39 are bent automatically by 90°, so that it is impossible for any single film to slip out from the right-hand edge 16, in particular. If a single pack is chosen, then the holding strip 14 shown in FIG. 3 should be bent upwardly or downwardly by 180° and then be glued either to the top 28 or the bottom 29. This could simultaneously be dsesigned, in conjunction with the gluing means, as an opening guarantee seal.

When in use, the packing is either used as shown in FIGS. 1 to 4 or a packing is removed from the container 52 and is cut off in such a way that there is formed a holding strip 41 and a pull strap 44. However, the envelope 19 could also be pre-perforated at this point, so that ripping is all that is required. The single pack is now placed into the cassette 53, which comprises a bottom part 54 and a top part 56 and is shown in dash-dotted lines in FIG. 3. These parts are of course light-proof in their closed state.

Figure 3:
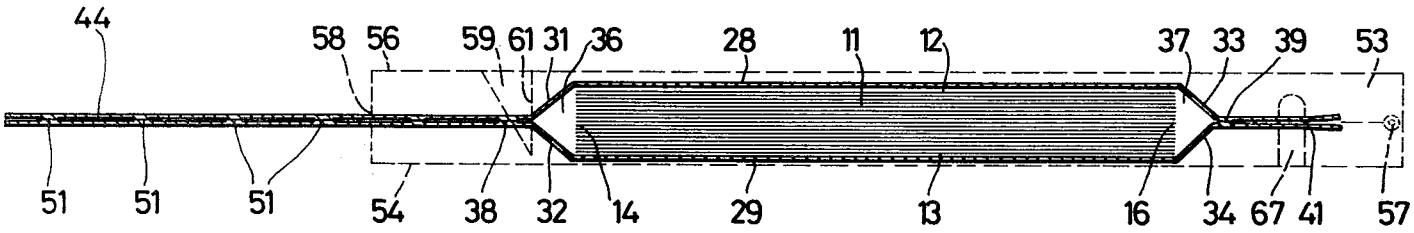
FIG. 3 shows a section along the line 3—3 shown in FIG. 1.

At the end that is the right in FIG. 3, the parts are connected by a hinge 57. In the cassette, there is provided a cutting device (not shown) which allows the gusset 37 to be cut off to the left of the cross-seam 39 by separation fo the areas 33, 34. This may be effected, for example, by placing the top part 56 on the bottom part 54 or there may be provided a draw knife such as is known on roll film cameras or the like device. To the right of the light trap 58, which is not shown in detail, the top part 56 is furthermore provided with two vertically downwardly projecting knives 59 which have a pointed triangular shape and whose right-hand edges are designed both as a cutting edge 61 and as a contact edge. When the top part 56 is folded down, the knives 59 penetrate the envelope 19 somewhere to the left of the left-hand margin 14. This may be either to the left of the cross-seam 38, in the cross-seam 38, or to the right of the cross-seam 38 in the gusset 36. If the pull strap 44 is now pulled to the left, while the cassette 53 is closed, the knives cut the ends 28, 29 open to the left of the cuts 62, 63, 64, 66 visible in FIGS. 6 and 7. As pulling continues, the left-hand margin 14 comes to rest against the cutting edges 61 and is thus positioned in an approximate manner. The stack 11 is not disposed in the cassette 53 and can be singled in the usual way. These singling mechanisms are known and feed single film to the exposure aperture of the camera.

Expediently, it is preferred to have in the area of the hinge 57 in the bottom part 54 two vertically upwardly pointing pins 67 which pass through the holes 42, 43, position the packing in the cassette 53 and retain the cut-off holding strip 41. Instead of the pins 67, it is of course also possible to clamp the holding strip 41.

In the exemplified embodiment shown in FIGS. 9 to 12, identical reference symbols are used for identical parts. Here, too, the envelope 19 is formed as a tube by a longitudinal seam 24. The longitudinal seam 24 extends over the entire length of the envelope 19. The envelope 19 is so dimensioned that it does not enclose the stack quite tightly — unless it relates to a vacuum packing, — nor so very loosely that the coherence between the single films in the stack 11 is lost. As in the first exemplified embodiment, one can see the longitudinal seam 24, the small curves 26, 27 which are practically stretched compared with those of the first exemplified embodiment, the top 28, the bottom 29, the areas 31, 32, 33, 34 which are more close-fitting than they are in the first exemplified embodiment, the gussets 36 and 37, a cross-weld 71 to the right of the gusset 37 in the end area of the holding strip 41, two holes 42 and 43 in the cross-weld 71 which are designed as oblong holes and are located asymmetrically to the geometrical longitudinal axis of the packing. The dash-dotted line 72 indicates the point where a knife 73 meets another knife 74. The knife 73 is stationary on the bottom 54 of the cassette 53, while the knife 74 is provided in the top 56 of the cassette 53, as indicated in FIG. 9. The cushion tips 47, 48, 46, 49 can also be seen, but they extend in a more tight-fitting manner than they do in the first exemplified embodiment. It is expressly emphasised that FIGS. 10 to 12 are constructional drawings which are true to scale. To the left of the centre portion 76, there is provided the pull strap 44 which is however provided, in contrast with the constructional form of the first exemplified embodiment, with an approximately 20 mm wide cross-weld 77 on the left-hand outside only. In all, this cross-weld 77 may be 40 mm, so that a cut or perforation can be made along the left-hand edge 78 in a continuous production. A suspension hole 79 is provided in the cross-weld 77.

From the weld 77, there extend to the right two longitudinal welds 81, 82, which directly adjoin the cross-weld 77, are approximately 55 mm wide, are arranged symmetrically to the geometrical longitudinal axis of the packing and end only very shortly forward of the left-hand edge 14. At that point, the longitudinal welds 81, 82 comprise widenings 83, 84. In the widenings 83, 84 rhombuses 86, 87 are shown which indicate the points where the tips of the two cutting edges 61 plunge. The centres of the longitudinal welds 81, 82 are aligned with the cutting edges 61.

For packings which are not vacuum-packed, there is provided a small welding point 88 not far from the left-hand edge 14, so as to ensure that the cutting edges 61 do not in any event cut a single film that may have slipped from the stack 11 to the left. Because of the knives 73, 74, which are designed as cross-cutters, the same type of welding point 89 may be provided not far from the right-hand edge 16.

In contrast with the cassette shown in the first exemplified embodiment, this cassette is provided for the motor-driven extraction of the packing, For this purpose, there are provided two rollers 91, 91 of which the lower roller 92 is driven, while the roller 91 only takes up the counter-pressure. The rollers 91, 92 are shown only symbolically. It is also possible to provide a set of several rollers or the rollers may be arranged one beside the other and not one on top of the other, so as to increase the looping angle.

In contrast with the first exemplified embodiment, the longitudinal seam 24 is located on the underside of the packing.

I claim:

1. A packing for loading a plurality of flat rectangular single non-X-ray films which have the same emulsion orientation directly into a daylight-loading camera cassette comprising a plurality of single films in a stack, each having a leading edge and a trailing edge, each of leading edges being cut straight and free of cut-away portions.

a foil envelope arrangement which surrounds the stack in a light-proof and climate-proof manner and has an easily weldable smooth plastic material foil as an internal layer, an aluminum foil as a central layer, an external layer, and has a plurality of weld seams which weld the foil arrangement together, of which two weld seams extend in parallel to each stack edge and at least one weld seam extends perpendicularly thereto and meets said two weld seams, the foil envelope arrangement is dimensioned to enclose and embrance the stack under normal pressure conditions tightly enough to maintain the coherence between the single films of the stack and to retain the films in their stacked orientation one above the other and to substantially limit the sideways movement of the stack but loosely enough to permit relative movement of the stack and the envelope perpendicularly to said two weld seams, the foil arrangement having two short gussets, one lying before the leading edge of the stack and one lying behind the trailing stack edge, substantially limiting the lengthwise movement of the stack.

the foil arrangement providing a holding strip not accessible to the stack the foil arrangement providing a pull strap not accessible to the stack extending to the other of said two weld seams and being substantially longer than the holding strip, the external layer being a smooth tension-proof plastic material foil.

2. A packing as claimed in claim 1. wherein the first single film to be moved away from the stack for exposure to light rests on the inside of the foil arrangement without an intermediate carboard being provided.

3. A packing as claimed in claim 1, wherein the last single film to be moved away from the stack for exposure to light rests against the inside of the foil arrangement without an intermediate cardboard being provided.

4. A packing as claimed in claim 1, wherein the internal layer is a polyethylene foil.

5. A packing as claimed in claim 1, wherein the external layer is a polyester foil.

6. A packing as claimed in claim 1, having a flat side, wherein there is only one weld seam extending peripendicularly to said two weld seams, which has a fold associated therewith and extends on the flat side of the packing.

7. A packing as claimed in claim 6, wherein the fold extends, together with the weld sea, approximately in the centre of the flat side.

8. A packing as claimed in claim 1, wherein the holding strip has at least one positioning hole.

9. A packing as claimed in claim 8, wherein two positioning holes are provided in the extending area of the holding strip.

10.A packing as claimed in claim 9, wherein at least the area around the positioning holes of the holding strip forms a wide cross weld.

11. A packing as claimed in claim 1, wherein the foil arrangement envelopes a plurality of separate identical stacks which are interconnected by the length of the pull strap plus the holding strip and this length is somewhat longer than the length of one stack.

12. A packing as claimed in claim 11, wherein a plurality of cross-welds are provided in the area of the pull strap.

13. A packing as claimed in claim 1, wherein a plurality of stack areas are arranged one above the other, so that the stack areas and the lengths formed by the pull strap and the holding strip are disposed in a zig-zag layer.

14. A packing as claimed in claim 1 wherein the holding strip is bent approximately 180° relative to the stack area and is fixed on the outside thereof by a label.

15. A packing as claimed in claim 1, wherein the area of the pull strap has transport holes for packing and for automatically unpacking, in the longitudinal weld seam.

16. A packing as claimed in claim 1, wherein the top and bottom of the pull strap are connected by a weld in the area in which a knife of a cassette plunges and wherein this area is continued as a longitudinal weld up to at least the next cross weld seam.

17. A packing as claimed in claim 1, wherein in the area in which two knives of a cassettte plunge there is provided two longitudinal welds.

18. A packing as claimed in claim 17, wherein a single cross weld is provided and one end of the two longitudinal welds passes into the cross weld at the end of the pull strap.

19. A packing as claimed in claim 18, wherein at the other end, the two longitudinal welds comprise a widening in the plunging area of the knives, but are otherwise narrower than the widenings.

20. A packing as claimed in claim 17, wherein the longitudinal welds are approximately 5 mm wide.

21. A packing as claimed in claim 19, wherein the widenings are approximately 8 mm wide and 6 mm long.

22. A packing as claimed in claim 1, wherein that at the end of the pull strap the cross weld seam is approximately as wide as the holding strip.

23. A packing as claimed in claim 1, wherein a suspension hole is provided in the cross weld seam.

24. A packing as claimed in claim 1, wherein the holding strip has positioning holes for pins of a cassette and these positioning holes are arranged at different distances from the centre of the packing.

25. A packing as claimed in claim 1, in which the packing interior has an environmental air pressure and has a small welded point approximately centrally and close to the edge of the stack directed towards the pull strap, which can be easily ripped open.

* * * * *

Disclaimer 4,158,409.—*Simon Duinker*, Bloemendaal-Molan, Netherlands. PACKING FOR SINGLE FILMS. Patent dated June 19, 1979. Disclaimer filed Aug. 7, 1980, by the inventor.

Hereby enters this disclaimer to claims 16–21 of said patent.

[*Official Gazette September 30, 1980.*]